United States Patent [19]

Cameron

[11] Patent Number: 5,011,001

[45] Date of Patent: Apr. 30, 1991

[54] TWIN CARRIAGE SYSTEM

[76] Inventor: Robert E. Cameron, Warrenton, Oreg.

[21] Appl. No.: 407,968

[22] Filed: Sep. 15, 1989

[51] Int. Cl.[5] ..... B65B 47/00

[52] U.S. Cl. ..... 198/468.2; 198/468.01; 198/468.9; 414/753; 83/435.1; 83/731

[58] Field of Search ..... 198/468.01, 468.2, 468.9; 414/753; 83/435.1, 435.2, 433, 409, 708, 731, 158, 157, 710, 711; 144/312, 378

[56] References Cited

U.S. PATENT DOCUMENTS

| | | | |
|---|---|---|---|
| 3,503,428 | 3/1970 | Ackerfeldt | 143/25 |
| 3,731,578 | 5/1973 | Ackerfeldt | 83/731 |
| 3,747,455 | 7/1973 | Hartzell et al. | 83/403.1 |
| 3,872,758 | 3/1975 | Hartzell et al. | 83/708 |
| 3,875,841 | 4/1975 | Noble et al. | 83/708 |
| 4,009,632 | 3/1977 | Detjen | 83/731 |
| 4,146,072 | 3/1979 | Detjen | 144/312 |
| 4,152,960 | 5/1979 | Detjen | 83/435.2 |
| 4,206,673 | 6/1980 | Detjen | 83/731 |
| 4,250,937 | 2/1981 | Detjen | 144/312 |
| 4,271,736 | 6/1981 | Jones | 83/435.1 X |
| 4,287,798 | 9/1981 | Cooper, Jr. et al. | 83/155 |
| 4,317,398 | 3/1982 | Jones et al. | 83/435.1 X |
| 4,445,411 | 5/1984 | Purcell | 83/403.1 |
| 4,628,781 | 12/1986 | Rowley | 198/468.2 X |
| 4,697,487 | 10/1987 | Cameron | 83/708 |

FOREIGN PATENT DOCUMENTS

| | | | |
|---|---|---|---|
| 2494169 | 5/1982 | France | 83/435.1 |
| 1411240 | 7/1988 | U.S.S.R. | 83/435.1 |
| 1412950 | 7/1988 | U.S.S.R. | 83/435.1 |

*Primary Examiner*—Robert P. Olszewski
*Assistant Examiner*—James R. Bidwell
*Attorney, Agent, or Firm*—Delbert J. Barnard

[57] ABSTRACT

Three parallel wide flange beams (B1, B2, B3) define parallel tracks (T) for side-by-side log carriages (C1, C2). Each log carriage (C1, C2) is an end-dog carriage and includes end dogs (D). Each carriage (C1, C2) is in two sections (10, 12). Each carriage section (10, 12) is supported for movement along its track (T) by four carriage wheels (W), one located at each corner of a carriage frame (F). The carriage wheels (W), the track rails (R1, R2, R3, R4) on which they ride, stabilizing rails (56, 58) and stabilizing wheels (SW) wrap the forces imposed on the carraiges (C1, C2) in a manner resulting in carriage travel along a substantially true line. The dog arms (54) include teeth (94, 96) which are divided into two rows separated by a V-channel (98). The outer faces of the teeth are parallel. The inner faces are defined by the channel (98) and are separated by a substantially sixty degree angle. The edges of the teeth (94, 96) converge as the teeth extend outwardly from the dog arm (54). The ends of the teeth (94, 96) are blunt.

13 Claims, 7 Drawing Sheets

TWIN CARRIAGE SYSTEM

TECHNICAL FIELD

This invention relates to end-dogging log carriage systems. More particularly, it relates to the provision of an improved end-dogging log carriage, an improved dog arm construction, and to a high speed twin carriage system utilizing such improvements.

BACKGROUND ART

Known end-dogging log carriage systems are disclosed by prior patent No. 4,697,487, granted Oct. 6, 1987, and entitled, "Adjustable Cable Driven Carriage System And Method," and by the patent documents listed therein. The main object of the present invention is to provide a relatively high speed log carriage system which is relatively lightweight and simple in construction. Another object is to provide a twin carriage system, composed of a pair of the improved carriages in a side-by-side arrangement. A further object of the invention is to provide an improved dog arm.

DISCLOSURE OF THE INVENTION

End-dogging log carriages of the invention are basically characterized by an elongated overhead track which provides laterally spaced-apart first and second support rails, each having an upper support wheel engaging surface. The carriage itself comprises first and second carriage sections. Each carriage section carries an end dog for dogging an end of a log. The carriage sections are adjustably interconnected, such as by means of a hydraulic cylinder. Each carriage section comprises a frame having inner and outer ends and first and second sides. A transverse axle is provided at each end of the frame on top of the frame. A carriage wheel is provided at each end of each axle. The carriage wheels contact the rails and serve to mount the carriage section for movement along the rails. Each end dog is pivotally connected to its carriage section frame at a location below the rails. Each end dog is positioned substantially vertically below the first support rail. An elongated stabilizing rail is positioned relatively adjacent the second support rail. Stabilizing roller means are provided at each end of each carriage section. The stabilizing roller means engage the stabilizing rail and, together with the support rails and the carriage wheels, stabilize the carriage section in position as it moves along the support rails.

In preferred form, each carriage section frame includes laterally spaced-apart side frame members. An end dog supporting axle extends between lower central portions of the side frame members. The carriage section frame includes rigid end frame portions. An elongated back beam extends between and interconnects the rigid end frame portions. A central portion of the back beam is positioned endwise of a first end of the end dog supporting axle. The end dog is connected to the opposite end of the end dog supporting axle.

Also in preferred form, the stabilizing rail has a substantially V-shaped cross section with a downwardly directed apex and downwardly converging side surfaces. The stabilizing roller means comprises a pair of rollers, one on each side of the stabilizing rail. Each stabilizing roller has a peripheral surface in rolling contact with the confronting side surface of the stabilizing rail.

Twin carriage systems of the invention are basically characterized by a pair of log carriages of the type described, arranged side-by-side, with the end dogs of the carriages being on the inner sides of the carriage frames, and positioned to travel closely adjacent paths.

End dogs according to the invention comprise an elongated narrow dog arm having substantially parallel sides and a log end engaging toothed edge portion. The toothed edge portion comprises a plurality of pairs of teeth spaced apart along the edge portion. Each tooth of each pair confronts the other tooth of the pair across a center channel. The center channel extends lengthwise of the edge portion, between two confronting rolls of teeth. In preferred form, each tooth has a sloping inner face which makes an acute angle with the sloping inner face of the confronting tooth, a pair of sloping edges which converge together as the tooth extends away from the dog arm, and an outer face which is substantially coplanar with the outer face of each flanking tooth and is substantially parallel to the outer face of each confronting tooth. Preferably also, each tooth has a blunt end and each tooth has a substantially trapezoidal profile. This construction of the teeth permits a good gripping engagement of the teeth into the ends of the log without splitting the log.

Other objects, features, and advantages of the invention are hereinafter described as a part of the description of the illustrated embodiment which is also the best mode of the invention.

BRIEF DESCRIPTION OF THE DRAWING

Like reference numerals and letters are used to designate like parts throughout the several views of the drawing, and.

BEST MODE FOR CARRYING OUT THE INVENTION

Figure 1:
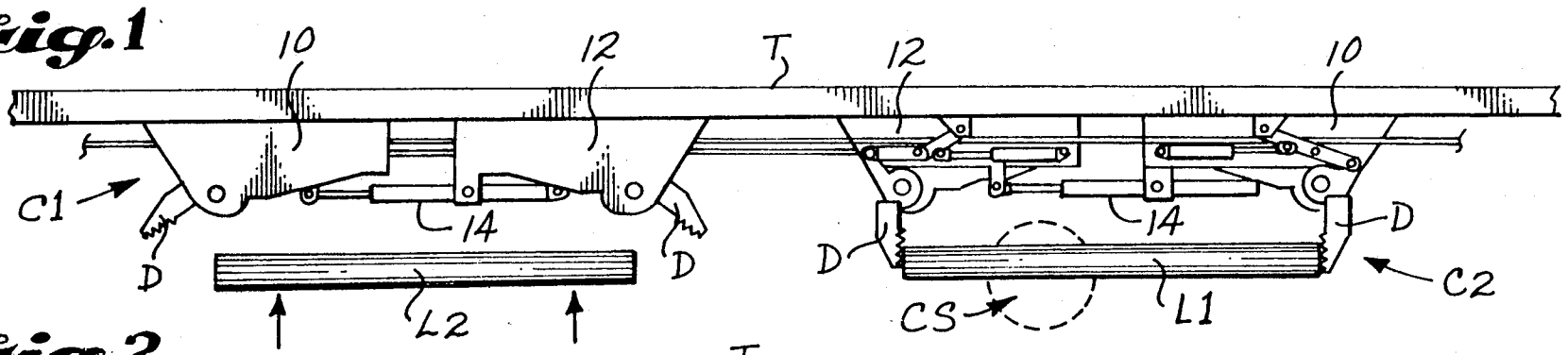
FIG. 1 is a side elevational view of a twin carriage system, composed of a pair of side-by-side end-dogging log carriages, such view showing a first of the carriages moving a log through a cutting station and the second carriage positioned to receive a log.
Figure 2:
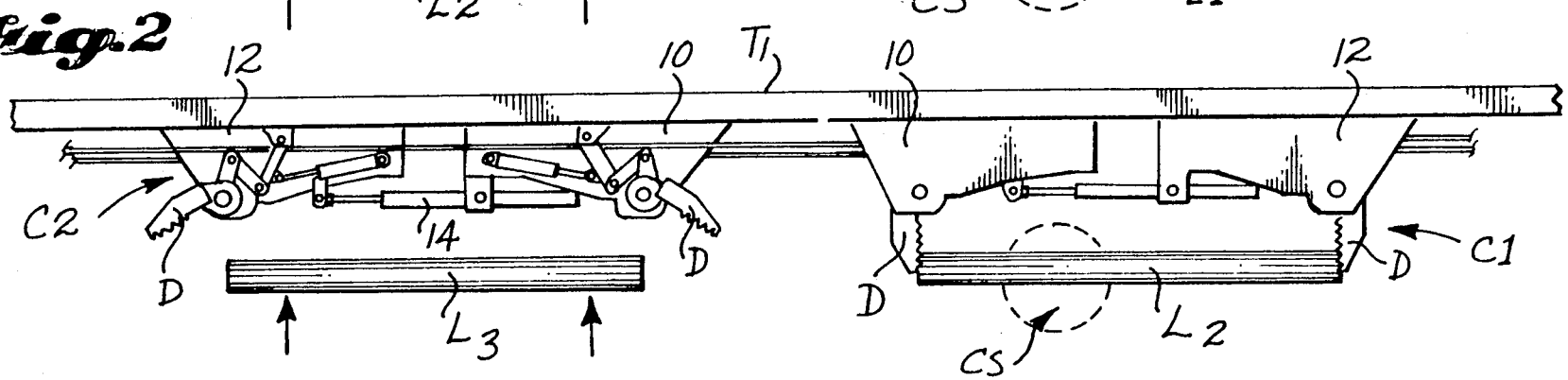
FIG. 2 is a view like FIG. 1, but showing the second carriage carrying a log through the cutting station and showing the first carriage in a position to receive a log.

FIGS. 1 and 2 show a twin carriage system comprising a pair of side-by-side carriages C1, C2 which travel along elevated parallel tracks T. Each carriage C1, C2 comprises a pair of carriage sections which are adjustably interconnected, such as by a hydraulic cylinder 14. Each carriage section 10, 12 carries an end dog D, movable between an elevated inactive position and a lowered log-engaging position. Referring to FIG. 1, a log L2 is shown being delivered to a pick-up station below carriage C1. Carriage C2 is shown carrying a log L1 through a cutting station CS. By way of example, a circular saw blade is shown at the cutting station CS. However, the invention does not depend on any particular cutting mechanism. A single circular saw blade, two spaced-apart saw blades, a gang saw, or one or more chipper heads may be utilized at the cutting station CS. Following positioning of log L2, the end dogs D are swung down to set the dog teeth into the opposite ends of the log L2. Then, the carriage C1 is moved towards the cutting station CS. FIG. 2 shows carriage C1 moving the log L2 through the cutting station CS while carriage C2 is back at the start position ready to pick up a new log L3.

As will later be explained, the carriages C1, C2 are constructed so that each can deliver a log to a single common cutting mechanism. Each log, regardless of which carriage C1, C2 it is on, is moved substantially along a straight path in a vertical plane. In a typical system comprising two spaced-apart cutters, for cutting material off of both sides of the log at the same time, the log path is along a line that is laterally between the two cutter mechanisms.

Figure 3:
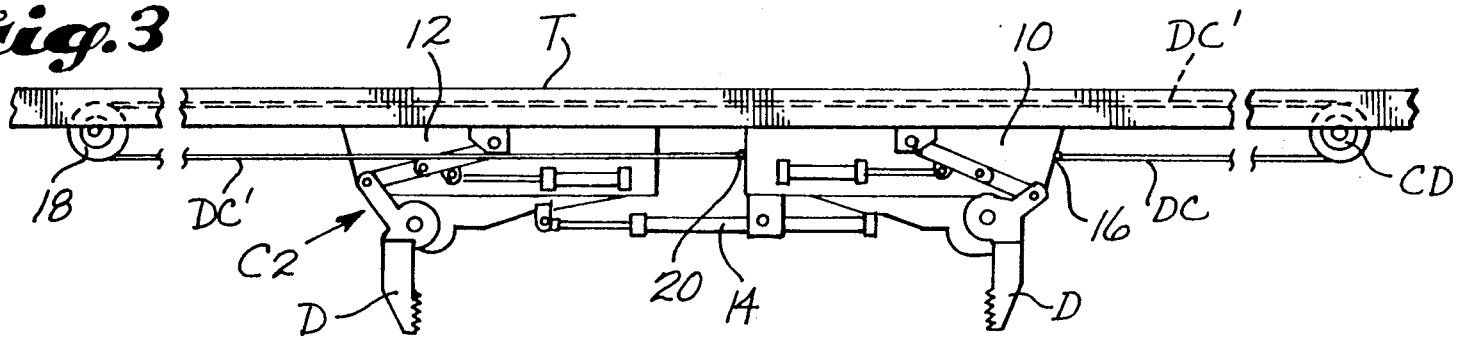
FIG. 3 is a side elevational view of a single end-dogging log carriage, showing the cable drive which moves the carriage back and forth along an overhead support track.

FIG. 3 shows the mechanism which moves each carriage C1, C2 along the overhead track T. FIG. 3 is a side elevational view looking towards one side of carriage C2. A side elevational view taken on the opposite side of the track T, towards carriage C1, would have a similar appearance. Referring to FIG. 3, a cable drum CD is shown mounted at one end of the track T. This drum CD is connected to a suitable reversible drive motor. The drive cable DC has a first section with an end 16 which is firmly anchored to carriage section 10. Drive cable DC extends from the anchor location 16 to the cable drum CD and is wrapped around the cable drum CD. A second drive cable section DC' is also wrapped on the drum CD. It then extends from the drum CD essentially the length of the track T to a sheave 18 mounted at the opposite end of the track T. Cable section DC' extends around the sheave 18 and then through carriage section 12 to a connection location 20 on carriage section 10. The hydraulic cylinder 14, or a substituted equivalent device, connects the carriage sections 10, 12 together.

When the cable drum CD is rotated counter clockwise, as illustrated in FIG. 3, the drive cable DC, between carriage section 10 and cable drum CD, is wrapped onto the cable drum CD. As a result, carriage section 10 is pulled by the drive cable DC toward the cable drum CD. The presence of the cylinder 14 causes carriage section 12 to move with it. Thus, the entire carriage C2 moves to the right (as illustrated), towards the cable drum CD. As movement occurs, the drive cable DC' extending between sheave 18 and anchor point 20 is pulled upon. This cable can move because its opposite end is moving off from the cable drum CD as the cable drum CD rotates. As will be apparent, a reverse rotation of the cable drum CD will cause the drive cable DC' to exert a pulling force on the anchor connection 20. Again, since the carriage sections 10, 12 are connected together, they will both move, this time to the left (as pictured). The drive cable DC' is wrapped onto the cable drum CD and the drive cable DC is paid off from the cable drum CD.

Referring to FIGS. 4, 6, 7 and 10, the overhead track T establishes parallel paths of travel for the two carriages C1, C2. Of course, in a single carriage system, there is only one path of travel. The carriage structure that is disclosed herein, and claimed, can be used by itself, in a single carriage system.

Advantageously, the carriage paths may be established by three, parallel beams B1, B2, B3. Each of these beams B1, B2, B3 extends the full length of the carriage track T. The beams B1, B2, B3 may be identical wide flange beams. However, the important feature is that beams B1 and B2 present a pair of confronting rails which are in coplanar parallelism. In similar fashion, it is necessary that beams B2 and B3 present confronting flanges which are in coplanar parallelism. The first set of flanges provide rails R1, R2 along which carriage C1 travels. The second pair of flanges provide rails R3, R4 along which carriage C2 travels. A track strip 22 of a suitable wear resistant material may be provided along the upper surface of each rail R1, R2, R3, R4.

Figure 9:
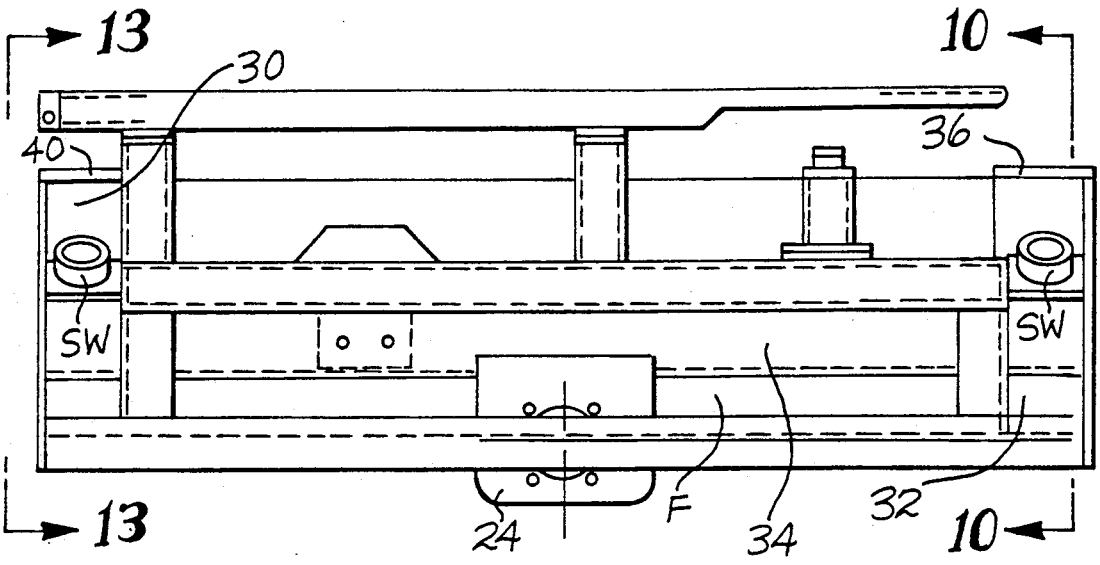
FIG. 9 is a side elevational view of a carriage section frame, such view being taken substantially from the aspect of line 9—9 of FIG. 10.
Figure 10:
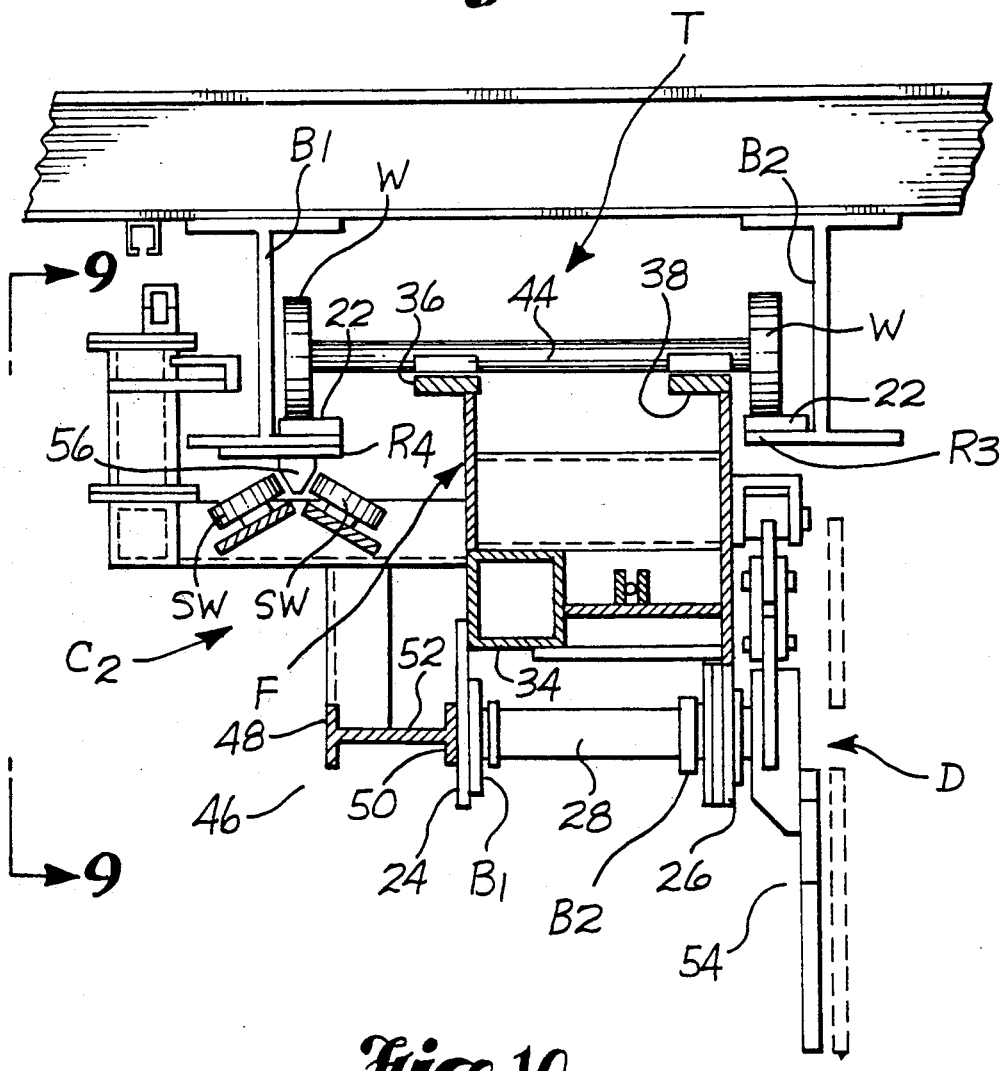
FIG. 10 is a sectional view taken substantially along line 10—10 of FIG. 9, but showing the carriage section framed together with the end dog mechanism, and further showing the guide track and carriage wheels.
Figure 11:
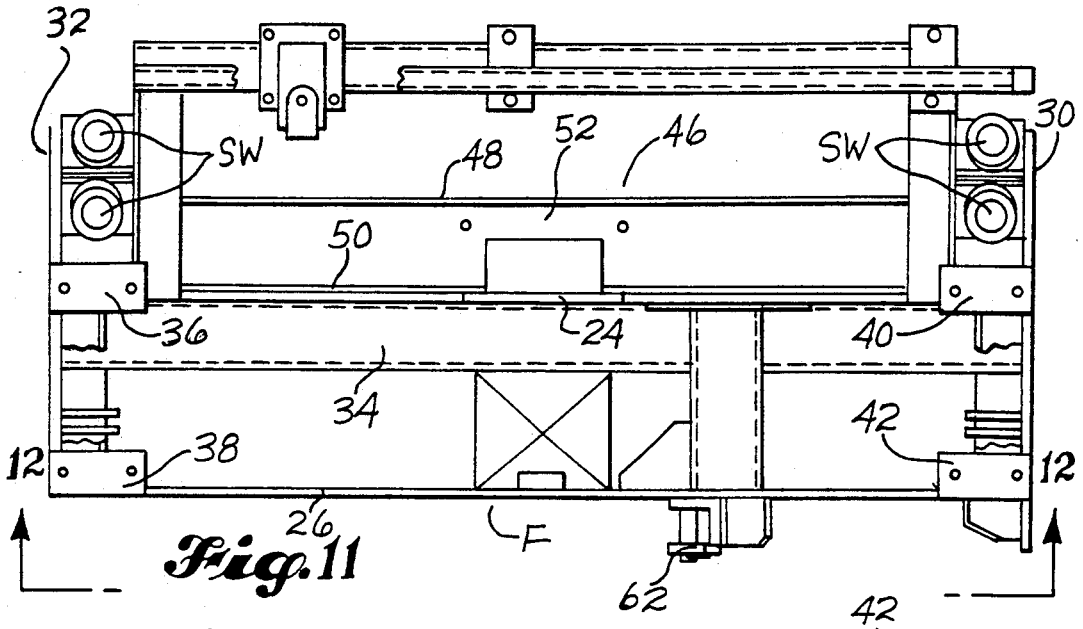
FIG. 11 is a top plan view of the carriage section shown by FIGS. 9, 10, 12 and 13, taken substantially along the aspect of line 11—11 of FIG. 12.
Figure 12:
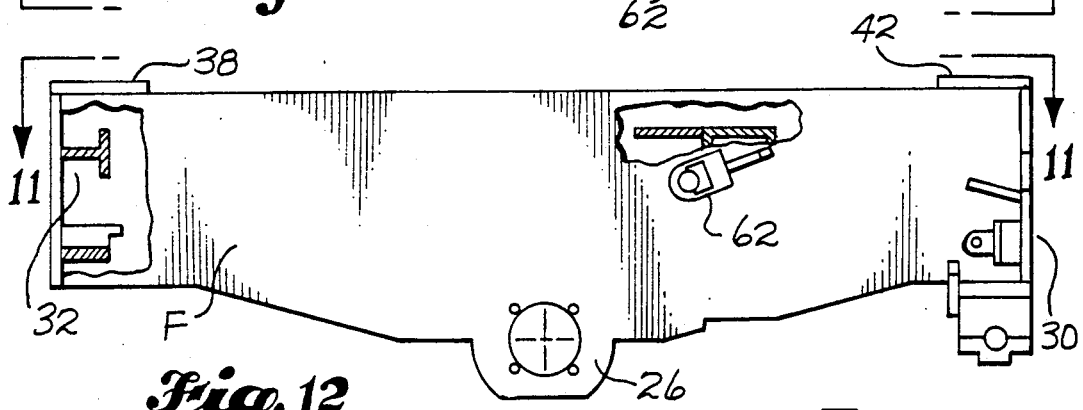
FIG. 12 is a side elevational view of the carriage section frame shown by FIGS. 9-10 and 13, taken substantially from the aspect of line 12—12 of FIG. 11.
Figure 13:
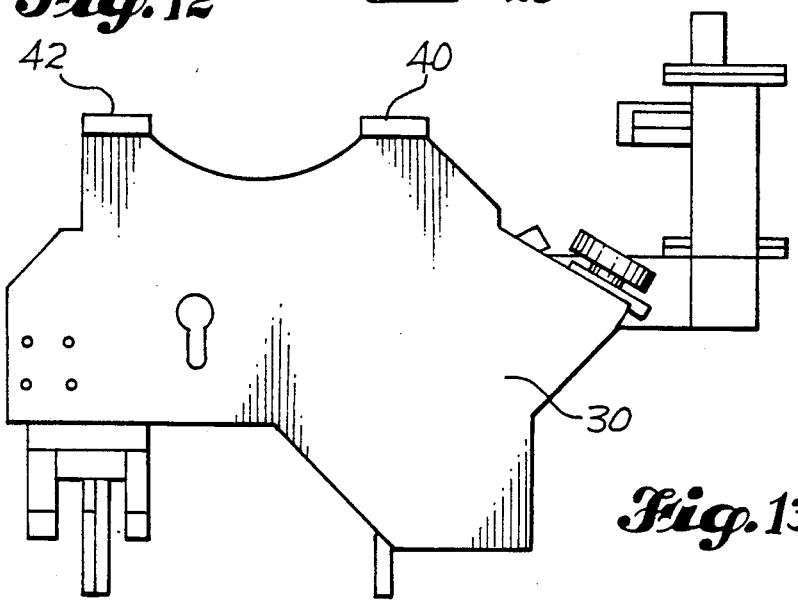
FIG. 13 is an end elevational view of the carriage section frame shown by FIGS. 9-12, taken substantially from the aspect indicated by line 13—13 in FIG. 9.

Reference will now be made to FIGS. 9-13 which show carriage section 12 for carriage C2. All of the carriage sections 10, 12 are basically alike, so it is only necessary to describe one of them in detail. FIG. 12 is a side elevational view of the carriage frame, looking towards the same side as in FIGS. 2-4. FIG. 9 is a side elevational view looking towards the opposite side of the frame F. As shown by FIGS. 9-13, the frame F comprises a pair of laterally spaced apart side members 24, 26 (FIG. 10), an end dog support axle 28 extending between lower central portions of the members 24, 26, and rigid end frame portions 30, 32. Side frame member 24 is at its top welded to a longitudinal box beam (e.g. 6"×6" steel box beam) 34.

Figure 4:
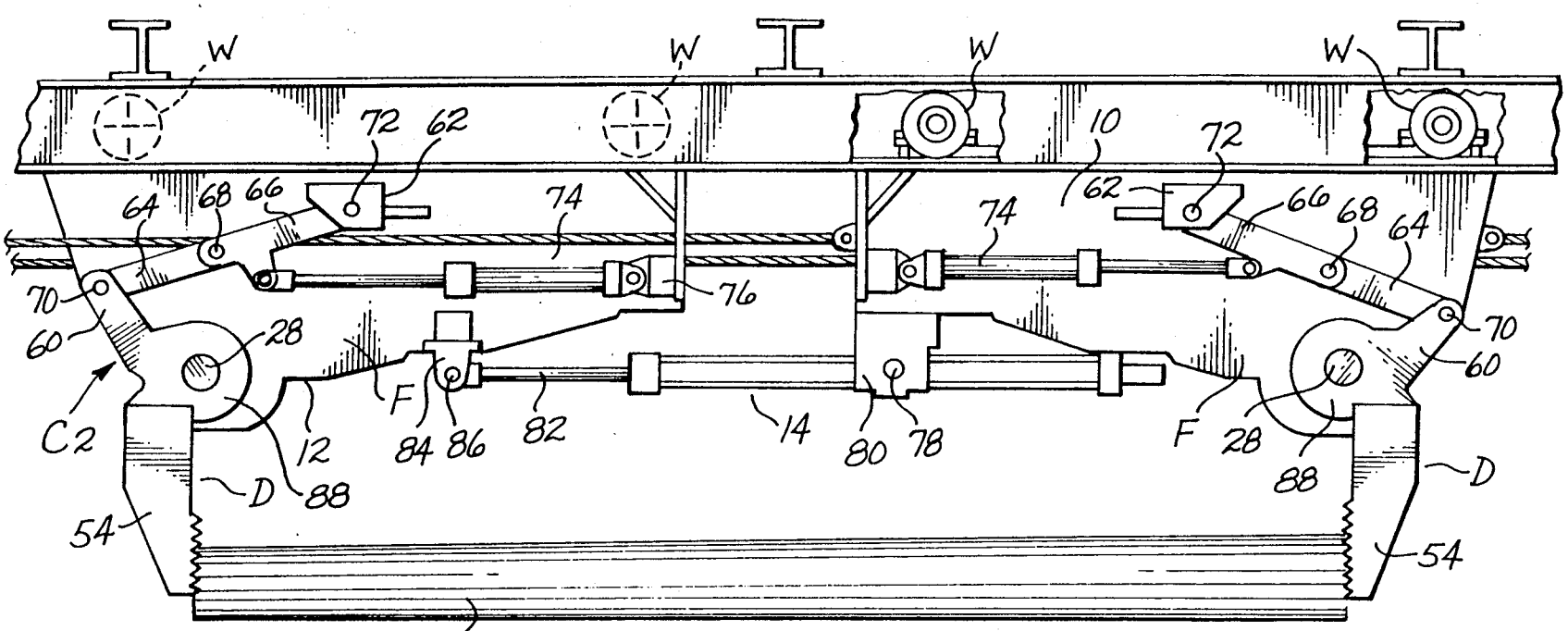
FIG. 4 is an enlarged scale side elevational view of a single end-dogging log carriage, looking towards the end dog side of the carriage sections, such view showing both end dogs down into a position gripping the end of a log.

The rigid end frame portions 30, 32 include mounting pads 36, 38, 40, 42 for mounting the axles of carriage wheels W which support the carriages C1, C2 on the rails R1, R2, R3, R4, for back and forth movement lengthwise of the track T. The mounting pads 36, 38 are located at the top of frame F at one end of the frame F. Mounting pads 40, 42 are located at the top of frame F at the opposite end of frame F. FIG. 10 shows a pair of carriage wheels W attached to the opposite ends of an axle 44. Axle 44 is suitably attached to the mounting pads 36, 38. A second pair of wheels W and a supporting axle are located at the opposite end of the carriage frame F with the axle being connected to the mounting pads 40, 42. This gives each carriage section 10, 12 four widely spaced-apart carriage wheels. The spacing of the wheels W in the lateral direction is shown in FIG. 10. The spacing of the wheels W in the longitudinal direction is shown in FIG. 4, and also by the spacing of the mounting pads 36, 38 relative to mounting pads 40, 42, in FIGS. 9, 11 and 12.

As best shown by FIG. 10, in a twin carriage system, the side members 22, 26 are offset towards the centerline of the machine. The end dog mechanism D is located outwardly adjacent side member 26, between it and the center line of the machine. As best shown by FIGS. 9-11, the frame F includes a back beam 46 which extends lengthwise of the frame F, on the side of frame F opposite the dog mechanism D. The ends of the beam 46 are connected to the rigid end frame portions 30, 32. As illustrated by FIG. 10, the back beam 46 may be an I-beam positioned with its flanges 48, 50 extending vertically and its web 52 extending horizontally. Flange 50 is against and is welded to member 24. Beam 46 is in alignment with the end dog supporting axle 28. Accordingly, it backs up the dog axle 28 and stiffens the frame against twisting and bending when the end dogs are forced against the opposite ends of the log.

Figure 8:
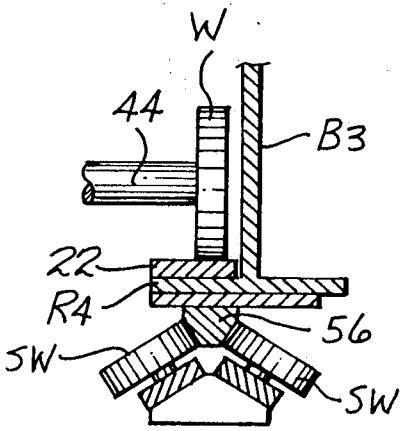
FIG. 8 is an enlarged scale fragmentary view in the vicinity of a stabilizing rail, showing a pair of wheels in contact with the opposite side spaces of the stabilizing rail, such wheels being secured to an end frame portion of a carriage section.

As shown by FIG. 10, the dog arm 54 is pivotally attached to an outer end portion of axle 28, at a location substantially vertically below ,rail R3. On the opposite side of the carriage C2, a stabilizing rail 56 is located immediately below rail R4. A similar stabilizing rail 58 is provided for carriage C1. It is located below and adjacent rail R1. Each stabilizing rail 56, 58 extends longitudinally of its rail R4, R1. It is suitably attached to the lower portion of its beam B3, B1. Each stabilizing rail 56, 58 is substantially triangular in cross section and has a downwardly directed apex and downwardly converging side surfaces. Each end frame portion 30, 32 carries a pair of stabilizing wheels SW. This is best shown by FIGS. 8, 10 and 11. The stabilizing wheels SW have peripheral portions which contact and roll along the side surfaces of the stabilizing rails 56, 58 as the carriages C1, C2 move along the track T.

The provision of four carriage wheels W, relatively widely spaced apart both laterally and longitudinally, provide a relatively stable wheel base for the carriages C1, C2. This wheel base, in combination with the stabilizing rails 56, 58 and the stabilizing wheels SW, causes the carriages C1, C2 to travel, with the carriage wheels W, down on the rails R1, R2, R3, R4. The use of wide flange beams B1, B2, B3 for the overhead track structure, makes it possible to provide and use stable wheel bases for the carriages C1, C2 within a minimum amount of space, utilizing a minimum amount of structure. The wide flange beams B1, B2, B3 are simple proven structural members. They are capable of carrying the weight of the carriages C1, C2 and the logs and at the same time the inside lower flanges perform a second function. They provide the rails R1, R2, R3, R4. The use of a relatively wide wheel base makes it possible to simply stabilize the carriages C1, C2 by use of the stabilizing rails 56, 58. The stabilized wheels SW take little room and a pair of them can easily be mounted at each end of each carriage frame F. The use of a stabilizing rail 56 having a triangular cross section, and opposite sides set at an angle, together with the use of stabilizing wheels SW set at an angle, provides stabilizing support in substantially all directions. The carriage wheels W on the sides of the carriages C1, C2 which carry the end dogs D, and the logs, are held down on the rails R2, R3 by the weight of the dogs D and the logs L. The stabilized wheels SW and the stabilizing rails 56, 58 keep the carriage wheels W which ride on the outside rails R1, R4 from being rotated upwardly off of the rails R1, R4 by the off-center weight of the dogs D and the logs. The use of a pair of stabilizing wheels SW, one on each side of each stabilizing rail 56, 58, prevents sideways travel of the carriages C1, C2, enabling the carriage wheels W to travel relatively true lines along the rails R1, R2, R3, R4.

Box beam 34 extends the full length of the frame F and at its end, is welded to the end frames. It and the beam 46 are parallel. They strengthen the frame F longitudinally and stabilize the axle 28. Axle 28 rotates and extends through bearings B1, B2. It then extends outwardly of plate 26. An overhung end portion is secured to the dog D.

Figure 5:
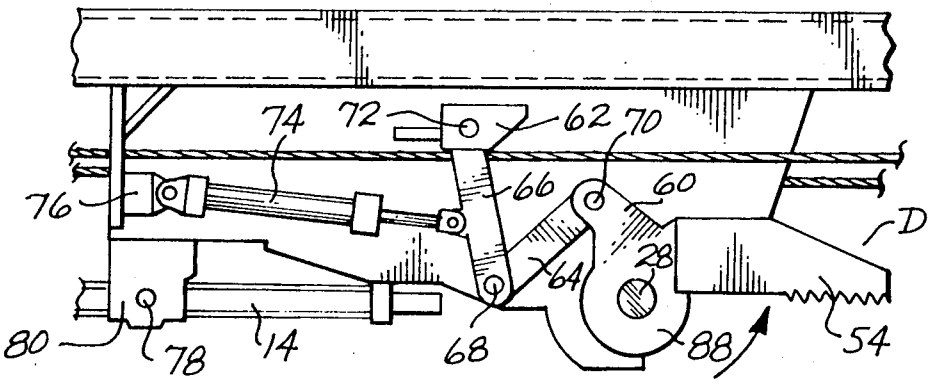
FIG. 5 is a fragmentary view of the right side (as pictured) of the log carriage section shown in FIG. 4, showing the end dog retracted.
Figure 6:
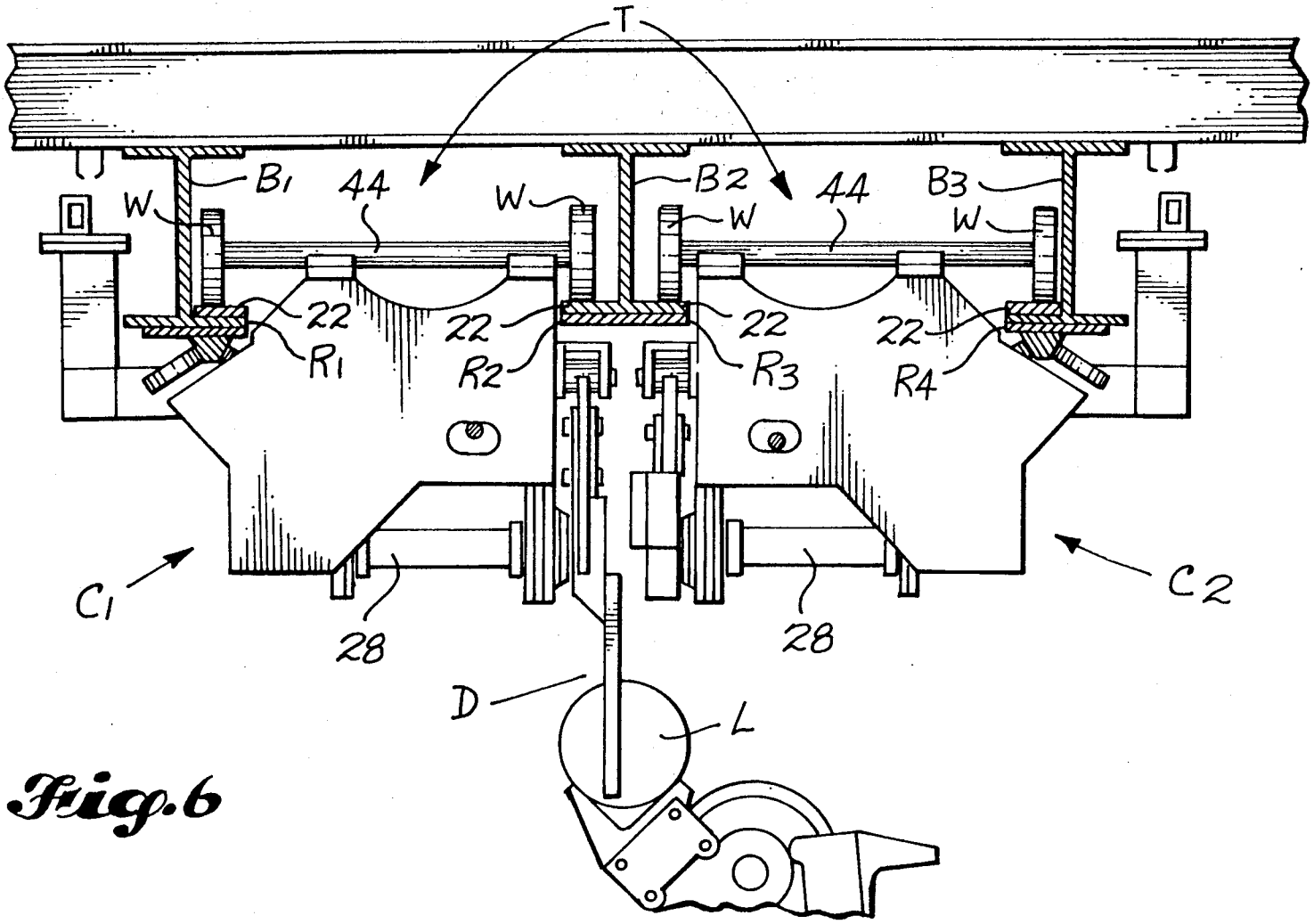
FIG. 6 is a cross-sectional view taken through a twin carriage system in the vicinity of a log delivery mechanism, such view showing a log at the uppermost position of the log delivery mechanism in the process of being connected to a carriage by its end dogs.
Figure 7:
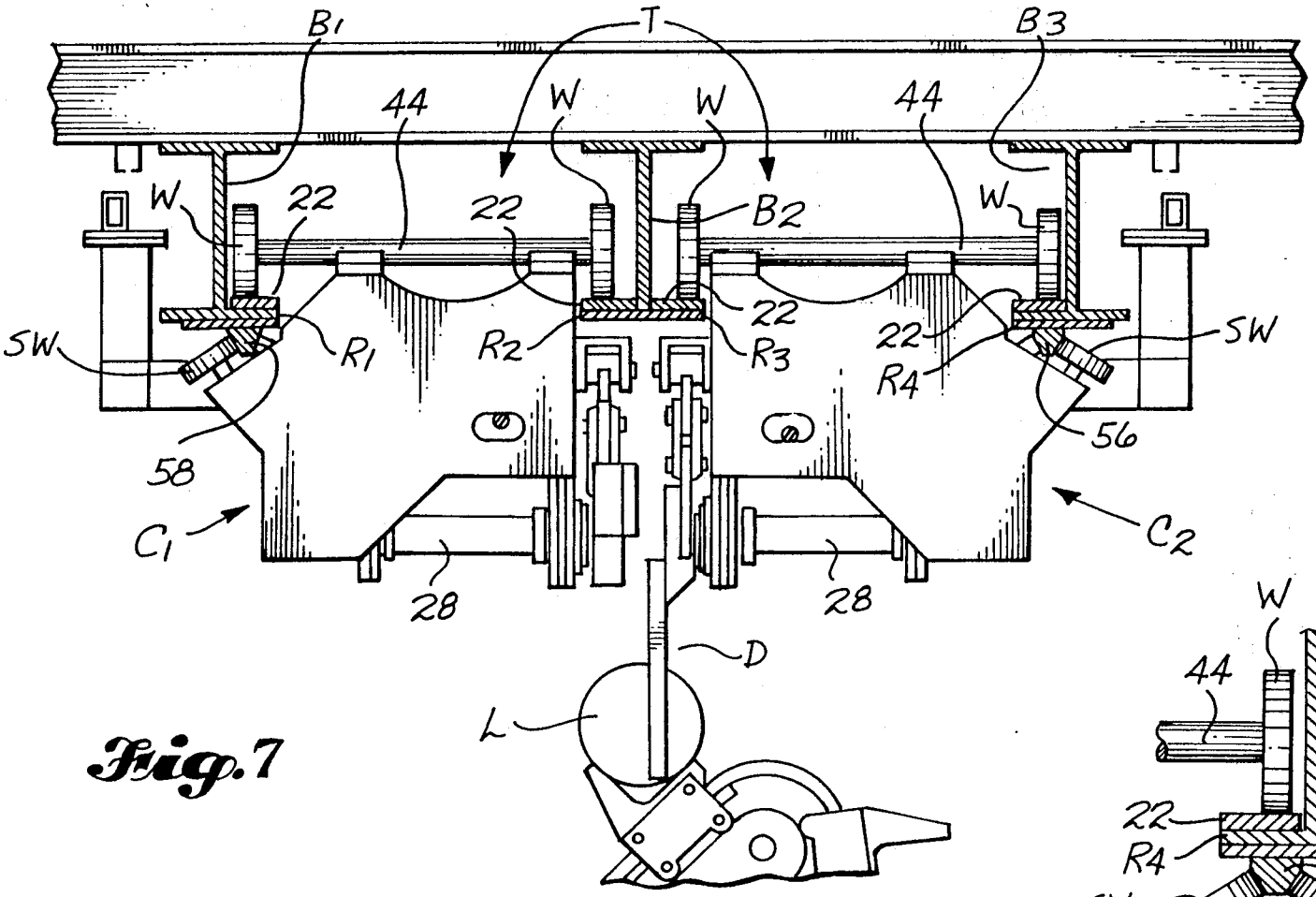
FIG. 7 is a view like FIG. 6, but showing another log at the uppermost position of the log delivery mechanism in the process of being connected to the second carriage by its end dog.

The end dog mechanism will now be described. Referring to FIGS. 4 and 5, each end dog D comprises a dog arm 54 having first and second ends. The first end is connected to a hub which is pivotally connected to a carriage section frame F, by means of a previously-described axle 28. A control arm 60 extends from the hub, generally away from the dog arm 54. An articulated connector arm is interconnected between the outer end of control arm 60 and a mounting pad 62 on the carriage frame F. This articulated arm comprises first and second control links 64, 66 which are pivotally connected together at their inner ends, by a pivot pin 68. The outer end of the first link 64 is pivotally connected to the outer end of arm 60 by a pivot pin 70. The outer end of the second link 66 is pivotally connected to the mounting pad 62 by a pivot pin 72. The axes of pivot pins 68, 70, 72 are parallel to the axes of axle 28. A double acting hydraulic cylinder 74 is interconnected between link 66 and a pad 76 on the conveyor frame F. Extension of the cylinder 74 straightens out the links 64, 66, forcing control arm 60 away from pad 62, and swinging dog arm 54 towards the end of the log L. Retraction of the cylinder 74 folds the links 64, 66 relatively together and pulls the control arm 60 towards pad 62. This causes a swinging movement of the dog arm 54 away from the log end and up into a substantially horizontal position (FIG. 5).

The forces imposed on the carriage sections 10, 12 by the interconnected cylinder 14, and by extension of the cylinders 74, for gripping a log between the dog arms 54, is reacted back to the stabilizing rail 22 and the carriage wheels W. As best shown by FIG. 4, a trunnion 78 connects a midportion of cylinder 14 to a depending portion 80 of section frame F. The outer end of piston rod 82 is pivotally connected to a structure 84 which depends from the section frame F of carriage section 12.

The pivotal connection is indicated at 86 and is provided by a pivot pin.

Figure 14:
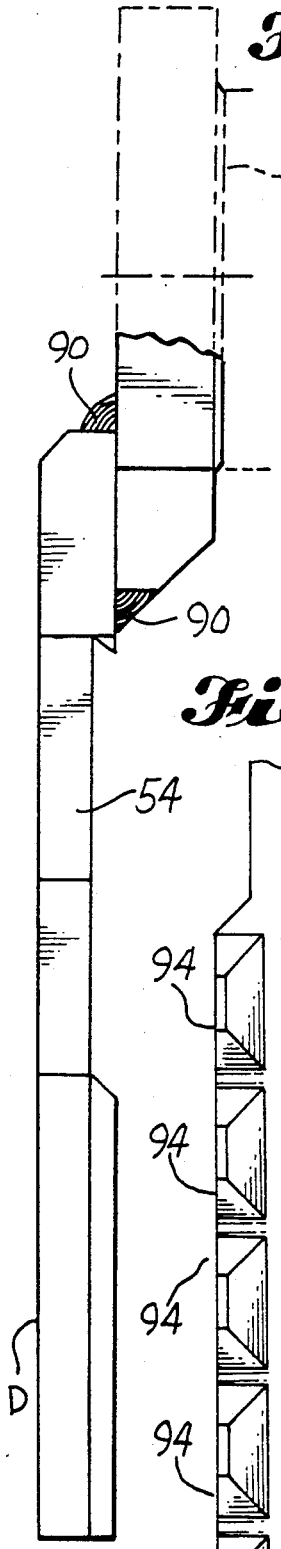
FIG. 14 is an end elevational view of an end dog, looking towards the edge of the dog arm opposite the log engaging teeth, with a mounting end portion of the end dog shown in phantom.

Referring now to FIGS. 4, 5 and 14–17, in preferred form, the hub or mounting portion 88 of each end dog D is positioned laterally adjacent side frame member 26. The dog arm 54 may be a separate member that is connected to hub portion 88, such as by welding at 90. As shown by FIG. 14, an inner end portion of dog arm 54 may sidelap a part of hub portion 88.

Figure 15:
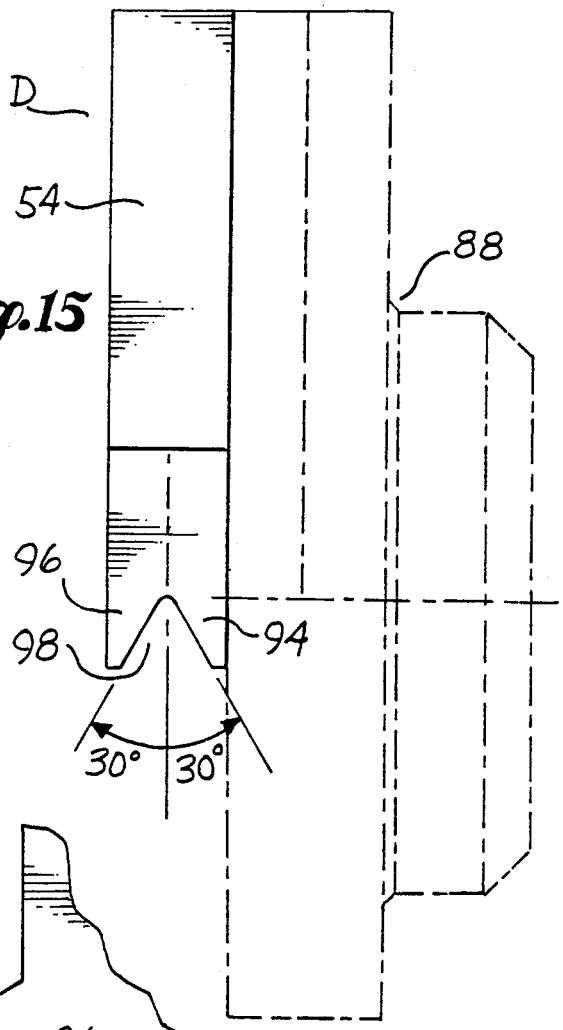
FIG. 15 is an end view of the end dog, looking towards the lower end of the dog arm, with the mounting portion of the end dog shown in phantom.
Figure 16:
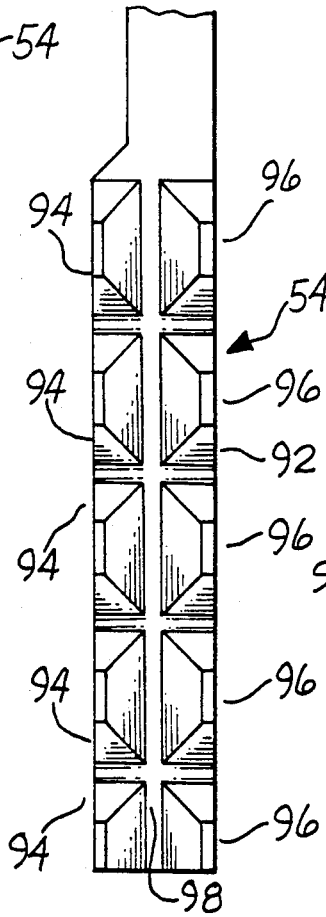
FIG. 16 is a fragmentary edge view of the tooth portion of the dog arm, looking directly towards the teeth.
Figure 17:
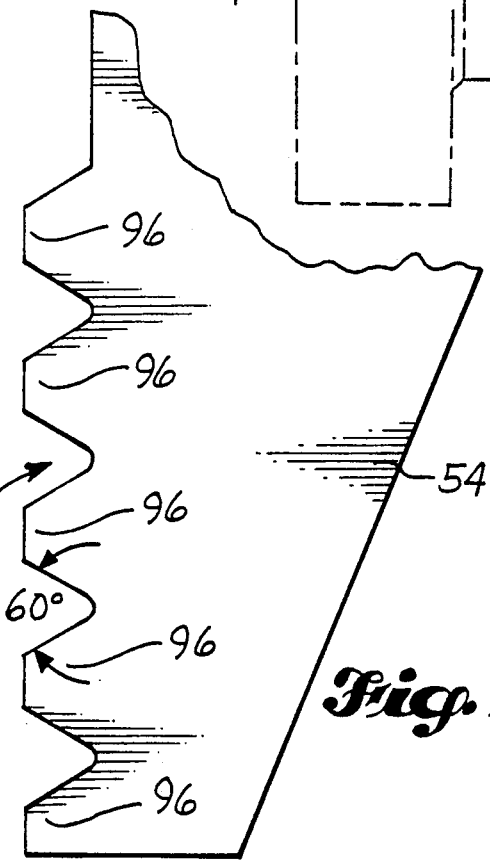
FIG. 17 is a fragmentary side elevational view of the tooth portion of the dog arm.

The free end of the dog arm 54 includes a toothed edge portion 92. In preferred form, this toothed edge portion comprises a plurality of pairs of teeth 94, 96 spaced along the edge 92. The teeth 94 are separated from the teeth 96 by a groove 98 which extends longitudinally of the edge 92. As best shown by FIGS. 15 and 16, the outer faces of the teeth 94, 96 are planar and the outer face of each tooth 94 is coplanar with the outer face of each other tooth 94 and is parallel with the outer face of each tooth 96. Preferably, the groove 98 has a substantially V-shaped cross section (FIG. 15), with a desirable angle being about sixty degrees (60°) between the confronting faces of the teeth 94, 96. Preferably, the teeth 94, 96 have blunt ends and side edges which converge as they extend outwardly from the dog arm 54. The valley angle between flanking teeth may also be about sixty degrees (FIG. 17). This construction of the teeth has proven to be desirable in that it provides a good grip between the dog arms 54 and the ends of a log without splitting the log L. It is also simple to construct.

As previously stated, the various features which have been illustrated and described can be used in a single carriage system or in a twin carriage system. The embodiment which is disclosed is the preferred mode. Coverage is not to be limited to this preferred mode, but rather is to be determined by an interpretation of the appended claims, using established rules of patent claim interpretation, including the doctrine of equivalents.

What is claimed is:

1. An end-dogging log carriage, comprising:

an elongated track comprising laterally spaced first and second track portions presenting inwardly directed first and second support rails, each said support rail including an upper support wheel engaging surface;

first and second carriage sections, each said section carrying an end dog for dogging an end of a log;

connector means extending between and adjustably interconnecting the carriage sections;

each carriage section comprising a frame having a top and inner and outer ends and first and second sides, a transverse axle at each end of said frame, on top of the frame, extending between said track portions above said rails, a carriage wheel at each end of each axle, said carriage wheels contacting said rails and serving to mount the carriage sections for movement along the rails;

each end dog being pivotally connected to its carriage section frame at a location below the rails, each end dog being positioned substantially vertically below said first support rail;

an elongated stabilizing rail positioned relatively adjacent the second support rail; and stabilizing roller means at each end of each carriage section engaging the stabilizing rail and, together with the support rails and the carriage wheels, stabilizing the carriage section in position as it moves along the support rails.

2. A log carriage according to claim 1, wherein the stabilizing rail has a substantially V-shaped cross section with a downwardly directed apex and downwardly converging side surfaces, and said stabilizing roller means comprises a pair of rollers, one on each side of the stabilizing rail, each stabilizing roller having a peripheral surface in rolling contact with the confronting side surface of the stabilizing rail.

3. A log carriage according to claim 1, wherein said elongated track is formed by and between a pair of parallel beams, each constituting one of said track portions and each presenting an inwardly directed flange, said flanges defining said first and second support rails, and said carriage wheels being positioned between said beams above said flanges.

4. An end-dogging log carriage, comprising:

an elongated track comprising laterally spaced first and second support rails, each said support rail including an upper support wheel engaging surface;

first and second carriage sections, each said section carrying an end dog for dogging an end of a log;

connector means extending between and adjustably interconnecting the carriage sections;

each carriage section comprising a frame having inner and outer ends and first and second sides, a transverse axle at each end of said frame, on top of the frame, a carriage wheel at each end of each axle, said carriage wheels contacting said rails and serving to mount the carriage section for movement along the rails;

each end dog being pivotally connected to its carriage section frame at location below the rails, each end dog being positioned substantially vertically below said first support rail;

an elongated stabilizing rail positioned relatively adjacent the second support rail;

stabilizing roller means at each end of each carriage section engaging the stabilizing rail and, together with the support rails and the carriage wheels, stabilizing the carriage section in position as it moves along the support rails; and wherein each carriage section frame includes laterally spaced side frame members, an end dog supporting axle extending between lower central portions of said side frame members, rigid end frame portions, and an elongated back beam interconnecting said rigid end frame portions and having a central portion positioned endwise of a first end of the end dog supporting axle, said end dog being connected to the opposite end of said end dog supporting axle.

5. An end-dogging log carriage, comprising:

an elongated track comprising laterally spaced first and second support rails, each said support rail including an upper support wheel engaging surface;

first and second carriage sections, each said section carrying an end dog for dogging an end of a log;

connector means extending between and adjustably interconnecting the carriage sections;

each carriage section comprising a frame having inner and outer ends and first and second sides, a transverse axle at each end of said frame, on top of the frame, a carriage wheel at each end of each axle, said carriage wheels contacting said rails and serving to mount the carriage section for movement along the rails;

each end dog being pivotally connected to its carriage section frame at a location below the rails, each end dog being positioned substantially vertically below said first support rail;

an elongated stabilizing rail positioned relatively adjacent the second support rail;

stabilizing roller means at each end of each carriage section engaging the stabilizing rail and, together with the support rails and the carriage wheels, stabilizing the carriage section in position as it moves along the support rails; and wherein each end dog includes a dog arm having first and second ends, with the first end being pivotally connected to its carriage section frame, a control arm at the first end of the dog arm, first and second control links having inner ends which are pivotally connected together and outer ends, with the outer end of the first link being pivotally connected to the control arm, and with the outer end of the second link being pivotally connected to the carriage section frame, and a double-acting hydraulic cylinder interconnected between said link and said carriage second frame, said cylinder being movable between an extended position in which the two links are substantially in alignment and the end dog is down in a log-engaging position and a retracted position in which the two links are folded relatively together and the end dog is retracted into a raised position.

6. An end-dogging log carriage system, comprising:

a pair of sequentially operated side-by-side end-dogging log carriages, each comprising:

an elongated track comprising laterally spaced first and second support rails, each said support rail including an upper support wheel engaging surface;

first and second carriage sections, each said section carrying an end dog for dogging an end of a log;

connector means extending between and adjustably interconnecting the carriage section;

each carriage section comprising a frame having inner end outer ends and first and second sides, a transverse axle at each end of said frame, on top of the frame, a carriage wheel at each end of each axle, said carriage wheels contacting said rails and serving to mount the carriage section for movement along the rails;

each end dog being pivotally connected to its carriage section frame at a location below the rails, each end dog being positioned substantially vertically below said first support rail;

an elongated stabilizing rail positioned relatively adjacent the second support rail; and stabilizing roller means at each end of each carriage section engaging the stabilizing rail and, together with the support rails and carriage wheels, stabilizing the carriage section in position as it moves along the support rails;

wherein the first support rail for one of the log carriages is laterally adjacent the first support rail for the other log carriage, and wherein the end dog for the first log carriage is closely laterally adjacent the end dog for the second log carriage.

7. A log carriage system according to claim 6, wherein each carriage section frame includes laterally spaced-apart side frame members, an end dog supporting axle extending between lower central portions of said side frame members, rigid end frame portions, and an elongated back beam interconnecting said rigid end portions and having a central portion positioned endwise of a first end of the end dog supporting axle, said end dog being connected to the opposite end of said end dog supporting axle.

8. A log carriage system according to claim 6, wherein the stabilizing rail for each log carriage has a substantially V-shaped cross section with a downwardly directed apex and downwardly converging side surfaces, and said stabilizing roller means comprises a pair of rollers, one on each side of the stabilizing rail, each stabilizing roller having a peripheral surface in rolling contact with the confronting side surface of the stabilizing rail.

9. A carriage system according to claim 6, wherein each end dog includes a dog arm having first and second ends, with the first end being pivotally connected to its carriage section frame, a control arm at the first end of the dog arm, first and second control links having inner ends which are pivotally connected together and outer ends, with the outer end of the first link being pivotally connected to the control arm, and with the outer end of the second link being pivotally connected to the carriage section frame, and a double-acting hydraulic cylinder interconnected between said link and said carriage second frame, said cylinder being movable between an extended position in which the two links are substantially in alignment and the end dog is down in a log-engaging position and a retracted position in which the two links are folded relatively together and the end dog is retracted into a raised position.

10. A log carriage system according to claim 6, wherein each said elongated track is formed by and between a pair of parallel beams, each presenting an inwardly directed flange, said flanges defining said first and second support rails, and said carriage wheels being positioned between said beams above said flanges.

11. An end-dogging carriage of a type including a pair of spaced-apart end dogs for dogging the opposite ends of a log and holding the log in position as the carriage moves the log relative to a cutter, the improvement comprising:

each end dog having an elongated narrow dog arm which includes substantially parallel opposite sides and a log end engaging toothed edge portion, said toothed edge portion comprising a plurality of pairs of teeth spaced apart along said edge portion, with each tooth of each pair confronting the other tooth of the pair across a center channel which extends lengthwise of the toothed edge portion, and with each tooth flanking at least one adjacent tooth on its side of the channel.

12. The improvement of claim 11, wherein each tooth has a sloping inner face which makes an acute angle with the sloping inner face of the confronting tooth, a pair of sloping edges which converge together as the tooth extends away from the dog arm, and an outer face which is substantially coplanar with the outer face of each flanking tooth and is substantially parallel to the outer face of each confronting tooth.

13. The improvement of claim 11, wherein each tooth has a blunt end.

* * * * *

UNITED STATES PATENT AND TRADEMARK OFFICE

CERTIFICATE OF CORRECTION

PATENT NO. : 5,011,001

DATED : April 30, 1991

INVENTOR(S) : Robert E. Cameron

It is certified that error appears in the above-identified patent and that said Letters Patent is hereby corrected as shown below:

Col. 1, line 13, "by prior" should be -- by my prior --.

Col. 5, line 42, ",rail" should be -- rail --.

Claim 4, col. 8, line 33, insert -- a -- after "at".

Claim 6, col. 9, line 42, "inner end" should be -- inner and --.

Claim 11, col. 10, line 41, insert -- log -- after "end-dogging".

Signed and Sealed this

Eighth Day of December, 1992

*Attest:*

DOUGLAS B. COMER

*Attesting Officer*

*Acting Commissioner of Patents and Trademarks*